US006702497B1

(12) United States Patent
Tien

(10) Patent No.: US 6,702,497 B1
(45) Date of Patent: Mar. 9, 2004

(54) CLEANING DEVICE FOR SMOOTH SURFACES, ESPECIALLY FOR CLEANING WINDOWS

(76) Inventor: Dieter Tien, Hakenstrasse 51g, D-48150 Nordhorn (DE)

( * ) Notice: Subject to any disclaimer, the term of this patent is extended or adjusted under 35 U.S.C. 154(b) by 0 days.

(21) Appl. No.: 10/030,556

(22) PCT Filed: Jul. 6, 2000

(86) PCT No.: PCT/EP00/06385

§ 371 (c)(1),
(2), (4) Date: Apr. 16, 2002

(87) PCT Pub. No.: WO01/01841

PCT Pub. Date: Jan. 11, 2001

(30) Foreign Application Priority Data

Jul. 6, 1999 (DE) ..... 299 11 772

(51) Int. Cl.[7] ..... A46B 11/02

(52) U.S. Cl. ..... 401/188 R; 401/205; 401/25; 401/23

(58) Field of Search ..... 401/188 R, 205, 401/206, 263, 261, 265, 266, 25, 26, 23

(56) References Cited

U.S. PATENT DOCUMENTS 3,721,502 A * 3/1973 Ognibene ..... 401/113
5,497,530 A * 3/1996 Kamm et al. ..... 15/321
6,065,890 A * 5/2000 Weitz ..... 401/146
6,547,469 B2 * 4/2003 Vito ..... 401/138

FOREIGN PATENT DOCUMENTS

DE 3802401 12/1989
DE 94057759 10/1994

* cited by examiner

*Primary Examiner*—David J. Walczak
(74) *Attorney, Agent, or Firm*—Milde & Hoffberg, LLP

(57) ABSTRACT

A cleaning device (100) for smooth surfaces, especially for cleaning windows. The inventive cleaning device comprises a handle (1) and a contact element (10) that is mounted on one end of said handle (1) and that extends in a substantially transversal direction to the handle (1). The contact element is provided with a cleaning surface element (4) on at least the one front face thereof that contacts the surface to be cleaned. The cleaning surface element can be wetted with a cleaning liquid in a controlled manner. A zone (5) is provided behind the cleaning surface element for the distribution and temporary storage of the cleaning liquid. The handle (1) is linked with a blade element (8) that is part of the contact element. The front face of said blade element is detachably linked with a direct removing element (7) that carries the cleaning surface element (4).

23 Claims, 11 Drawing Sheets

CLEANING DEVICE FOR SMOOTH SURFACES, ESPECIALLY FOR CLEANING WINDOWS

BACKGROUND OF THE INVENTION

The present invention relates to a cleaning device for smooth surfaces, especially for cleaning windows, with the following components:

A handgrip,

A contact element mounted on the end of the handgrip that essentially extends perpendicular to the handgrip, And a cleaning surface element capable of being moistened and mounted on at least the front side coming in contact with the surface to be cleaned and provided with a cleaning fluid, and an output plate Behind which is located an area for the distribution and temporary storage of the cleaning fluid, And that the handgrip is shaped essentially as a cylindrical hollow body and serves as a reservoir for at least a portion of the cleaning fluid.

The German Patent No. DE 38 02 402 A1, discloses a cleaning device with a handgrip and a cleaning head that includes an output plate coming into contact with the surface to be cleaned.

The output plate forms a wall of the cleaning head. A surface cleaning element in the form of a sponge or numerous brush elements is mounted directly on the aperture plate. The cleaning fluid is supplied from an interior chamber of the cleaning head to the sponge or brush via the apertures of the aperture plate. The dosing is not controllable, however, so that the cleaning fluid may drip from the sponge, particularly when the cleaning device is pressed against the surface to be cleaned. Another disadvantage is that the surface cleaning element may be exchanged only together with the aperture plate, and perhaps together with a surrounding inserted frame.

Further, the German Patent No. DE 94 05 755.9 describes a device to clean window glass that also consists of a handgrip and a cleaning head. The cleaning head includes a water reservoir and a single output opening through which the cleaning fluid may be pumped into a cleaning sponge.

SUMMARY OF THE INVENTION

The principal object of the present invention is to provide a handy, compact cleaning device in which dripping of the cleaning fluid supplied to the surface cleaning element may be avoided.

This object is achieved by the invention in that

The area for the distribution and temporary storage of the cleaning fluid includes an at least partially hollow, flat dirt-removing element with at least one capillary matrix distributing the cleaning fluid, whereby the cleaning surface element is mounted on the dirt-removing element so that it may be removed, And that the contact element is provided with a recess in the region of its connection with the handgrip into which an actuation lever for a pump is at least partially inserted and by means of which the cleaning fluid may be supplied to the dirt-removing element.

It is essential to the invention that the cleaning fluid may be transferred via a manually operated pump into the dirt-removing element that forms a part of the area used for the distribution and temporary storage of the cleaning fluid. This area may be mounted directly to the dirt-removing element in the form of suitable capillary openings, slots, and/or channels. This distribution and temporary storage area for the cleaning fluid preferably consists of a capillary matrix worked into the output plate that matches corresponding slots of the dirt-removing element. This output plate is preferably arranged between a section of material forming the cleaning surface and the dirt-removing element. In a preferred embodiment, the material section forming the cleaning surface consists of a moisture-permeable textile or sponge-like material and is preferably so attached to the dirt-removing element (e.g., using a hook and loop closure) that both sides of it are useable. The material section may also be mounted as a hood on the output plate or on the dirt-removing element using clamps, a rubber band, or similar removable fastener.

The contact element may be formed as one piece with the handgrip, or may be attached to it by means of clamp, ratcheting element, or bayonet connectors so that it may be removed.

The handgrip serving as the reservoir for the cleaning fluid is preferably in the form of a cylindrical hollow body that is manufactured as one piece with the crosspiece, also hollow.

The handgrip may be attached via a swivel to the contact element or crosspiece and/or with a handle extension at the end opposite the crosspiece.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
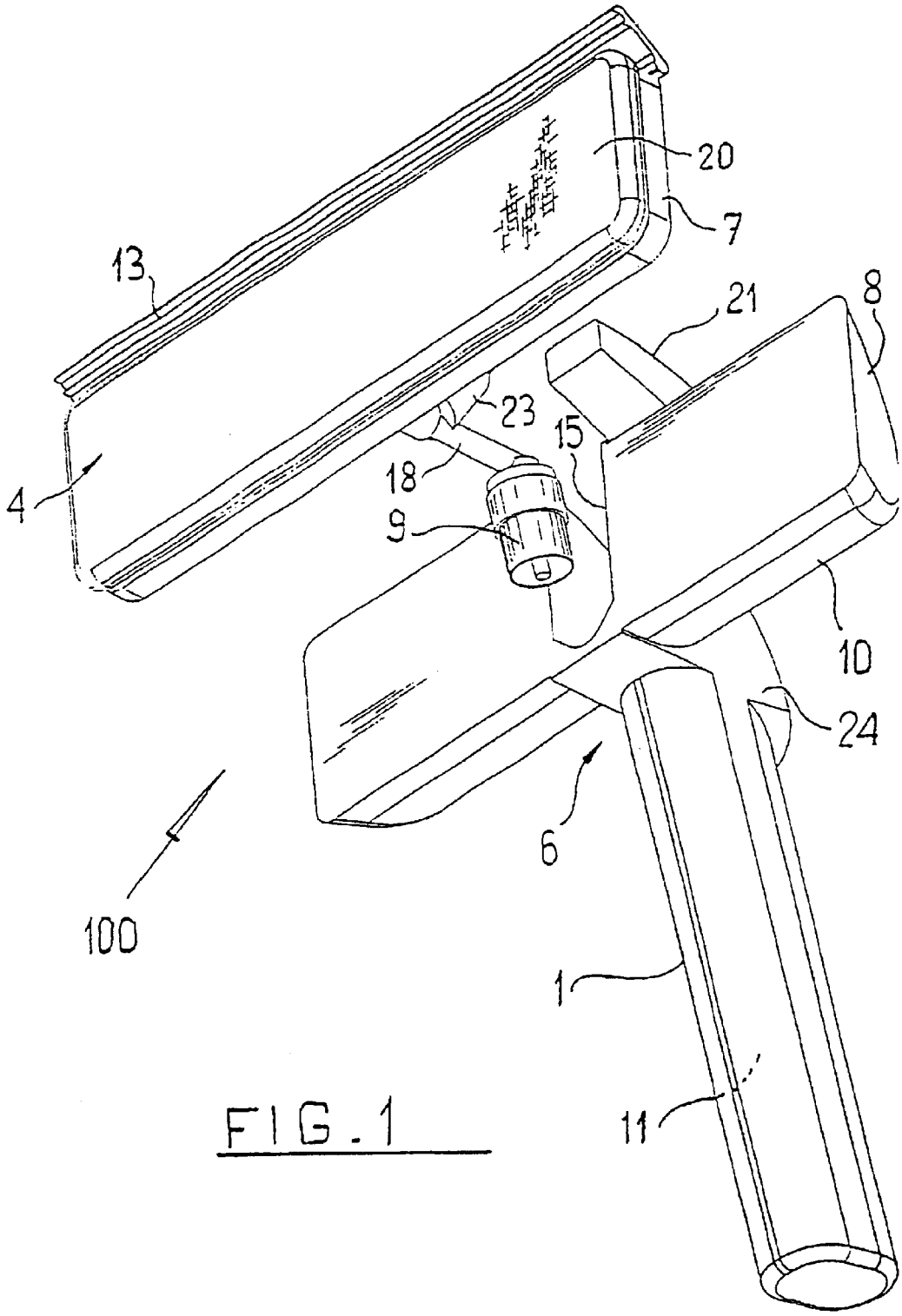
FIG. 1 is a disassembled perspective view of a cleaning device in a first preferred embodiment of the invention.
Figure 2:
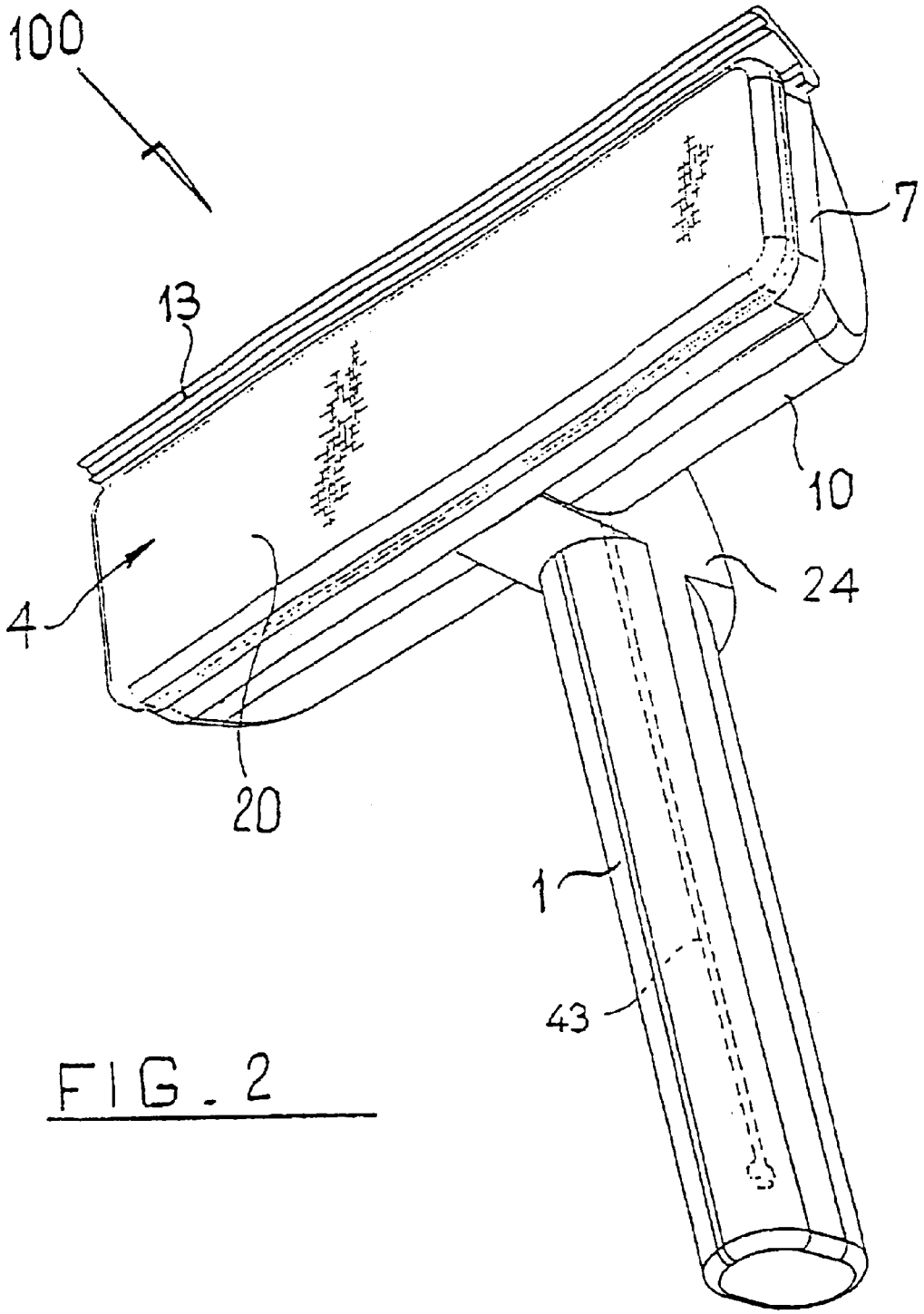
FIG. 2 is a perspective view of an assembled cleaning device as in FIG. 1.

The preferred embodiments of the present invention will now be described with reference to FIGS. 1–12 of the drawings. Identical elements in the various figures are designated with the same reference numerals.

FIGS. 1, and 2, 4, 5, 6, 7*a* and 7*b* show a compact cleaning device 100 and 300 that includes a handgrip 1 and a contact element 10. The contact element 10 contains a surface-conforming cleaning surface element 4 on its front side facing the surface to be cleaned (not shown) that, in these embodiments, is made of a section 20 of a moisture-permeable material, in this case a fleece cloth made of micro-fibers, or of woven or knitted fabric, which is preferably dirt-absorbing on both sides. The element 4 includes a hook-and-loop hook section 65*a* on at least one side. One or more mating hook-and-loop sections 65*b* are attached to a partially-hollow, flat, rectangular dirt-remover 7 that contains a distribution line in its interior that leads to an area 5 used for distribution and temporary storage of a cleaning fluid. A detailed description of the area 5 follows based on FIGS. 5 through 7*b*.

The handgrip 1 is formed as a hollow body with a hollow chamber 11 that serves as a reservoir for cleaning fluid. The handgrip 1 becomes a hollow, semi-cylindrical crosspiece 8 extending perpendicular to the handgrip, whose flat front side 22 is congruent and in contact with the rear side of the dirt-removing element 7.

As FIG. 1 shows, the crosspiece 8 includes a centrally-located recess 15 to hold a piston pump 9. The piston pump 9 is connected with the interior of the dirt-removing element 7 via a short tube. Further, a supply tube 43 is connected to the pump that extends from above into the hollow chamber 11.

A relatively thin, springy actuation lever 21 is mounted on the rear side of the crosspiece 8 that may be depressed against a thickening 24. The piston pump 9 is actuated by the lever 21. Cleaning fluid located in the hollow chamber of the handgrip 1 is sucked up via a line 43 and forced into the dirt-removing element via a suitable valve control system. The cleaning fluid reaches the area of the surface cleaning element 4 via the small capillary apertures 30.1 . . . 30.n. Further, a shaped squeegee strip 13, preferably of synthetic rubber material, is mounted on an upper edge 17 of the dirt-removing element 7.

When the cleaning device 100 is in assembled condition, the dirt-removing element 7 is connected with the crosspiece 8 so that it may ratchet. For this purpose, the dirt-removing element 7 includes two engaging elements 23 extending above its rear side (FIG. 1 shows only one engaging element 23) that may be tensioned and inserted into the recess 15 of the crosspiece 8.

Figure 3:
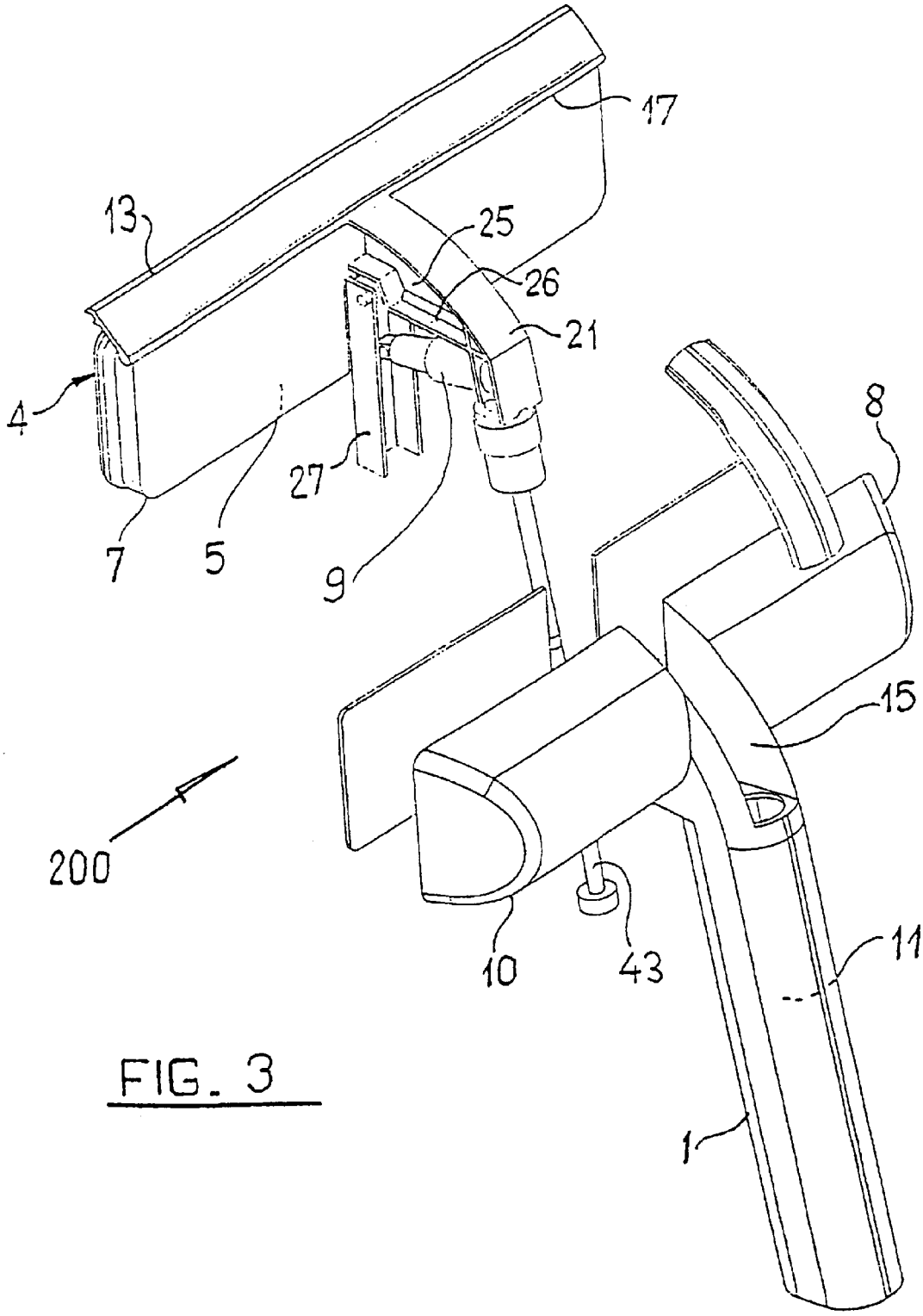
FIG. 3 shows a second preferred embodiment of the cleaning device seen from the rear in a perspective, disassembled view.
Figure 4:
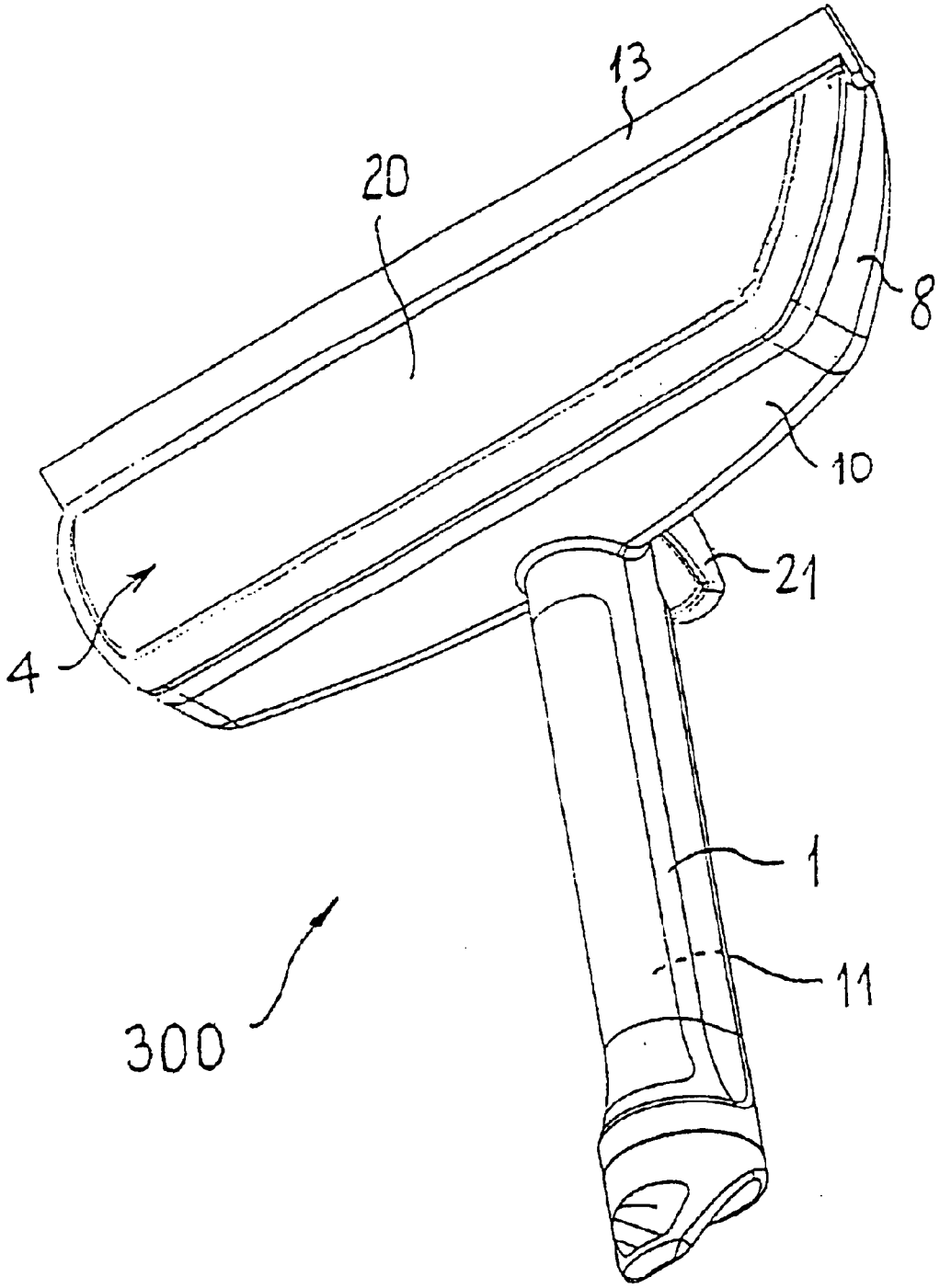
FIG. 4 shows a third preferred embodiment of the cleaning device in perspective view.

A second embodiment example (reference number 200) is shown in FIG. 3. The design shown in the illustration is similar to that of the cleaning device 100. One difference is that a C-shaped piece 27 mounted on two reinforced strips 25, 26 serves as the actuation lever for the piston pump 9 that may be gripped by the fingers of the hand gripping the handgrip. Otherwise, the pump function may be taken from the description of FIG. 1. Reinforced strips 25, 26 and the C-shaped piece are left in a recess 15. The reinforcing strips 25, 26 are firmly attached to the dirt-removing element 7.

FIGS. 4 through 7*b* show a preferred embodiment of the cleaning device subject to the invention (reference number 300). A thin output plate 28 including a row of apertures or capillary matrix 19 for cleaning fluid is incorporated in the dirt-removing element 7 facing the material section 20. The capillary matrix 19 consists of a row of capillary apertures 30.1 . . . 30.n that run parallel to the upper edge 29 of the output plate 28. The output plate 28 is also provided with a strip 31 extending above its flat side that engages in a slot 32 on the dirt-removing element 7 (see FIGS. 5 and 7*a*), and serves as a securing element for the squeegee strip 13. A thickening 33 of the squeegee strip 13 is also pressed or inserted into the slot 32 (see FIGS. 5 and 6). The output plate 28 is welded to the dirt-removing element 7 using ultrasound. In another embodiment, the dirt-removing element 7 may also be glued to the output plate 28.

Figure 5:
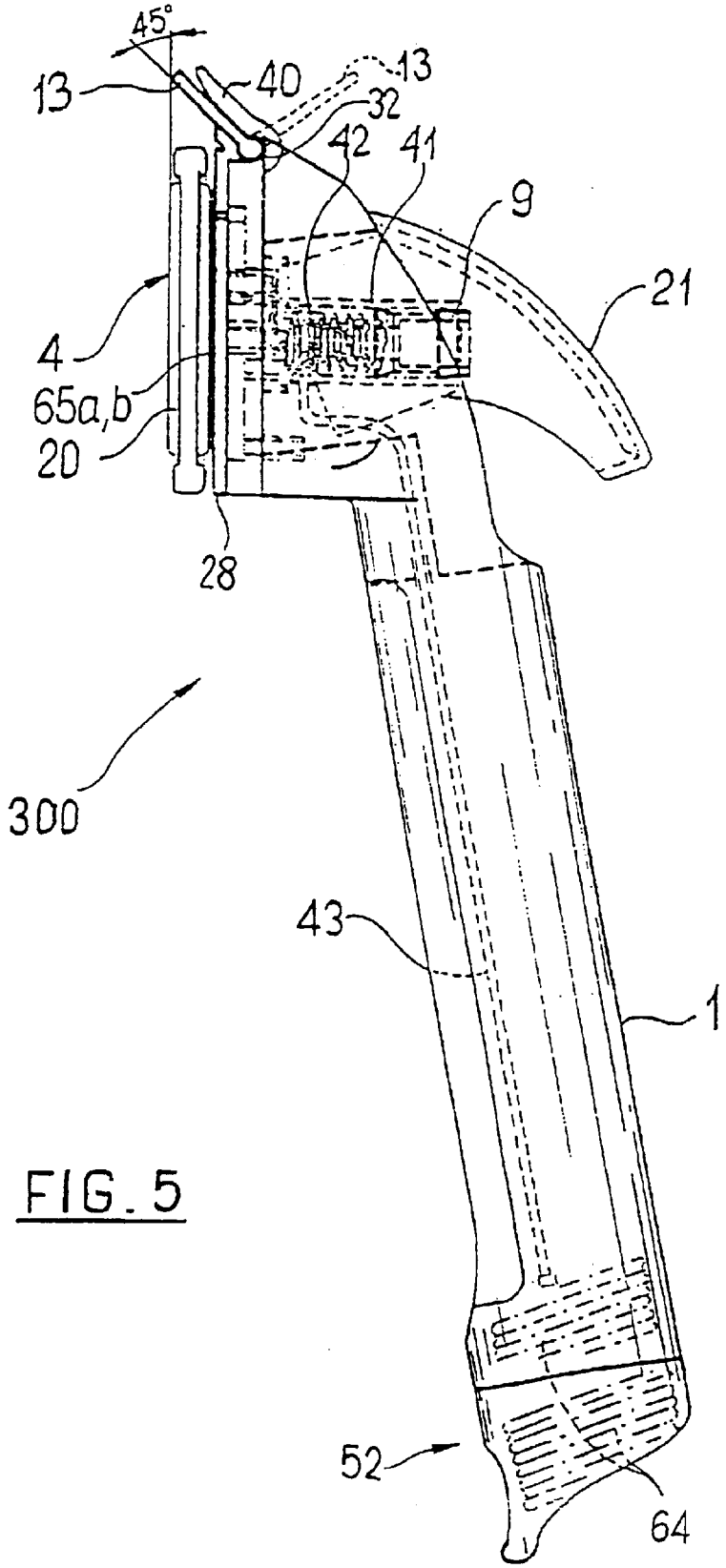
FIG. 5 is a schematic longitudinal view of the cleaning device as in FIG. 4, with a visible pump.
Figure 6:
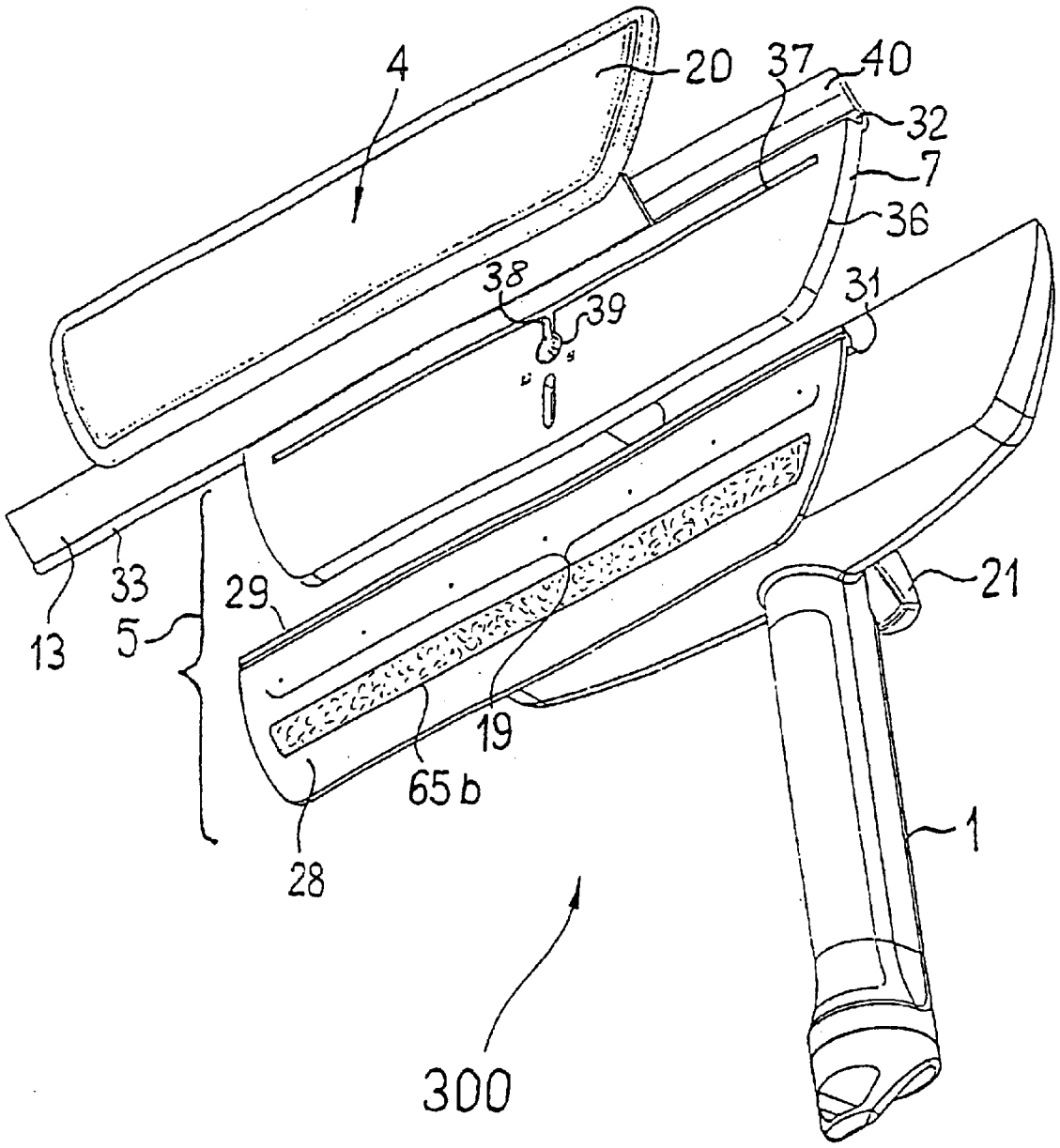
FIG. 6 is a perspective, disassembled view of the cleaning device as in FIG. 4.
Figure 7A:
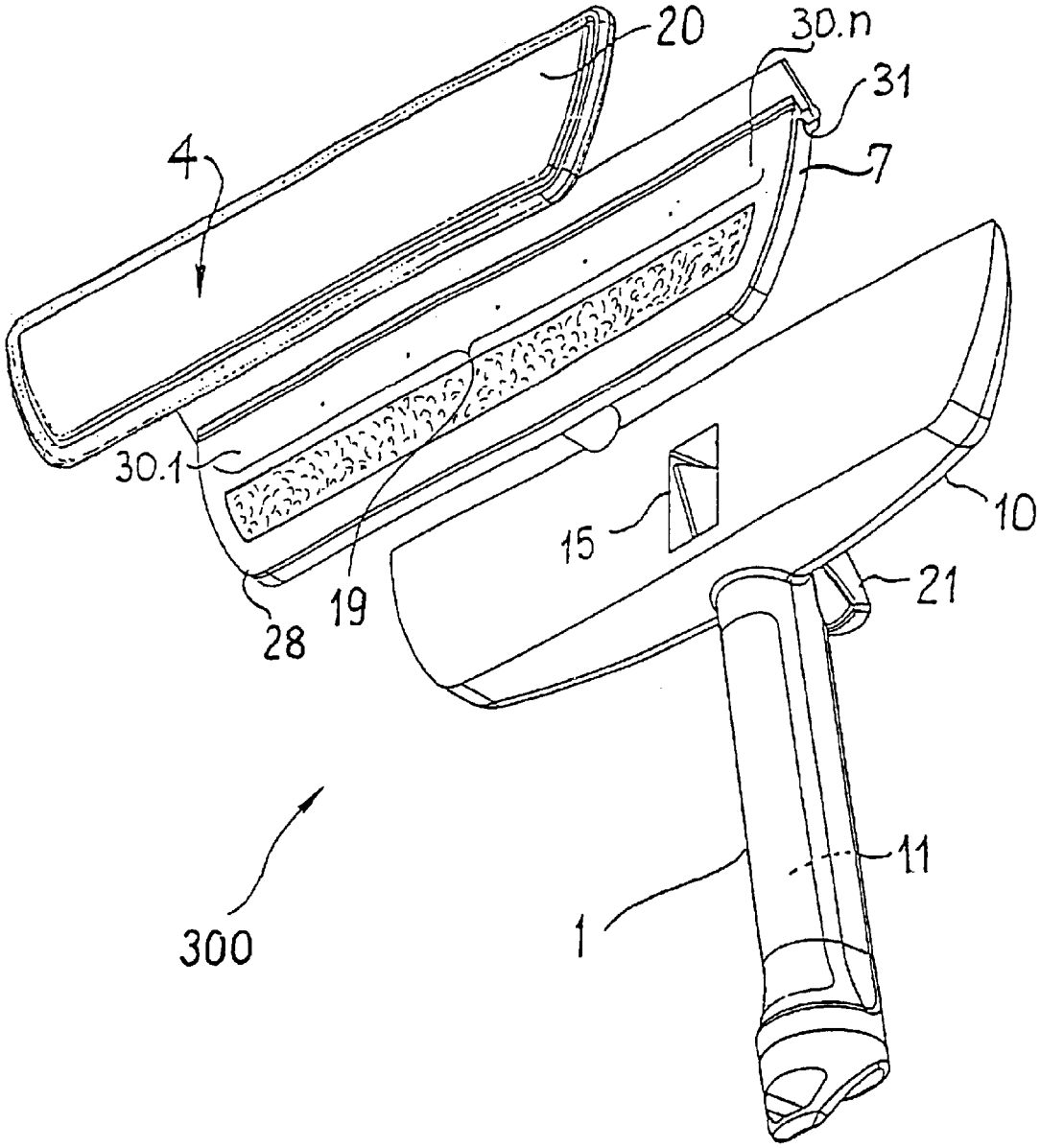
FIGS. 7*a* and 7*b* show the cleaning device as in FIG. 4 in exploded view, seen from the front and rear, respectively.
Figure 7B:
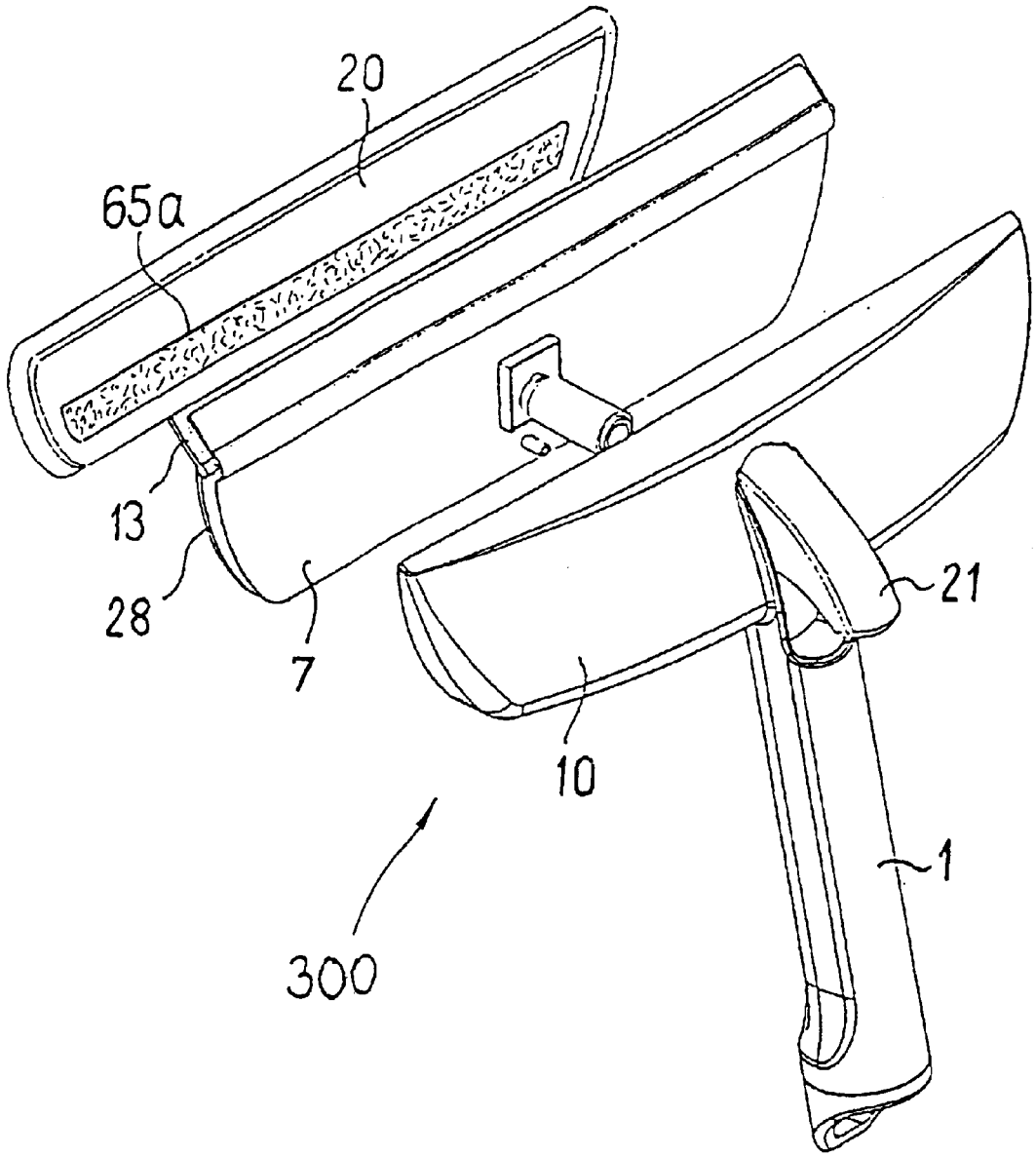

Further, the dirt-removing element 7 includes an upper reinforced strip 40 extending above its entire width (see FIGS. 5 and 6) that extends at an angle into the previously-mentioned slot 32. The reinforced strip 40 and the upper edge of the output plate 28 determine the position of the squeegee strip 13 inserted into the slot 32. As FIG. 5 shows, the inclination angle of the squeegee strip 13 with respect to the cleaning surface 4 is about 45°. This arrangement ensures good support for the squeegee strip 13 that may be used or replaced.

FIG. 5 also shows with dotted lines a squeegee strip 13 folded back. In this embodiment, the squeegee strip 13 is supported in the slot 32 with the reinforced strip 40 removed so that it may swivel. The squeegee strip 13 may also be provided with staged double- or triple-squeegee edges, whereby such squeegee strips are arranged in the slot 32 so that they may move or swivel.

A slot 37 parallel to the upper edge 17 of the front side 36 of the dirt-removing element 7 may be seen that becomes a shorter slot section 38 reaching the center of the dirt-removing element 7. This slot section 38 ends with a penetrating aperture 39, by means of which the cleaning fluid may be pumped into the slot 37 and into the capillary matrix 19 covering it. The elements designated with 19, 37, 38, and 39 form the area 5 used for distribution and temporary storage of the cleaning fluid. Suitable cleaning fluids are tap water, with or without additives such as common detergents, window glass cleaners, or biologically-degradable cleaners.

The pump 9 of the cleaning device 300 is positioned perpendicular to the flat side of the dirt-removing element 7 within a shell 41 (see FIG. 5). The pump 9 includes a cylindrical return spring 42 that is tensioned when the actuation lever 21 is pressed. Pressing down the actuation lever 21 causes the pump piston to move, so that the cleaning fluid is suctioned from the hollow chamber 11 of the handgrip 1. As in a child's water pistol, repeated pressing on the actuation lever forces the cleaning fluid into the area of the capillary apertures, so that the cleaning fluid may flow into the cleaning surface element 4 and be distributed there without causing total saturation. If the cleaning surface element 4 is removed from the cleaning device, the capillary apertures are exposed. In this case, the cleaning device may also serve to spray cleaning fluid directly onto the surface to be cleaned, thereby moistening it.

Figure 8A:
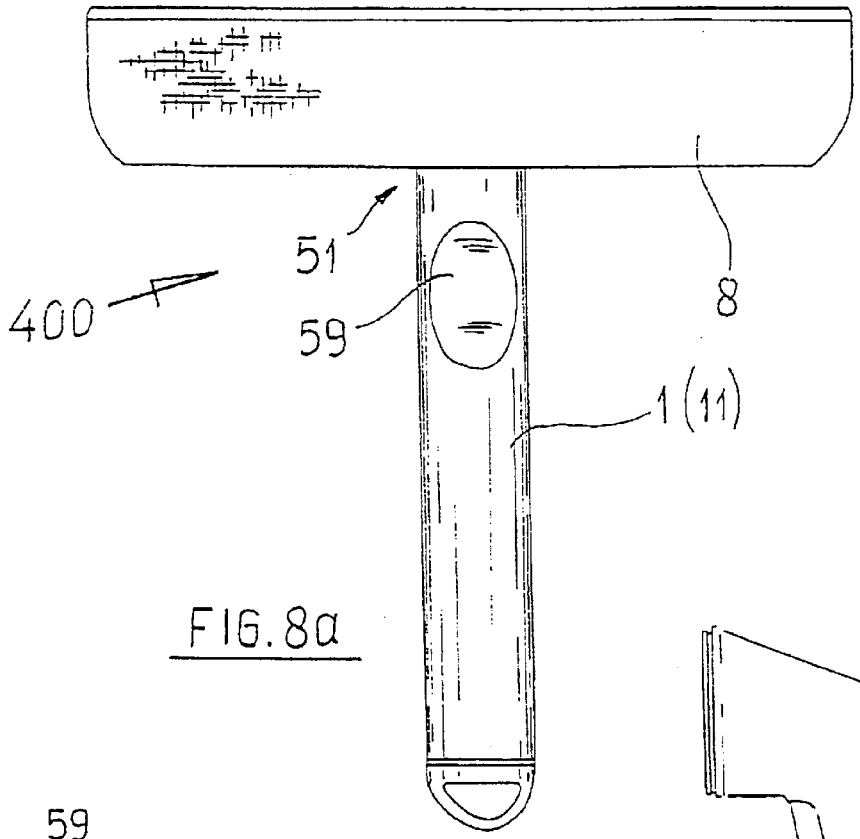
FIGS. 8*a* to 8*c* show mounting options for the membrane element on a cleaning device.
Figure 8B:
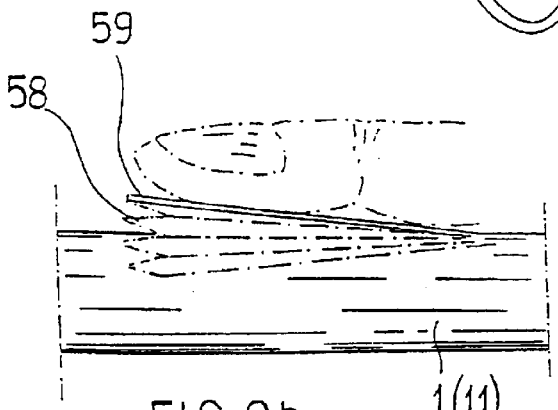
Figure 8C:
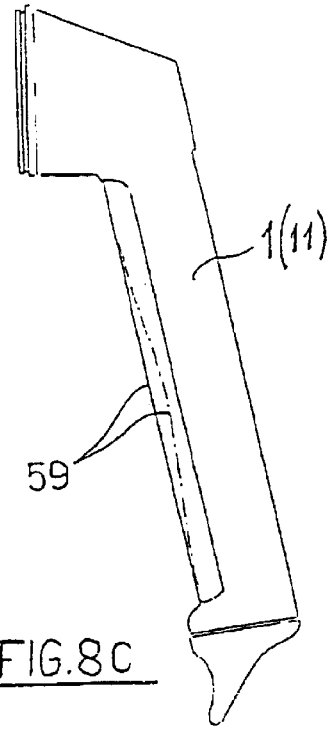

The mechanism to transport the cleaning fluid to the cleaning surface may be simplified by the use of a simple membrane element 59 instead of a piston pump 9 that may be deformed by hand pressure, thus providing a pumping action. Such an embodiment of the cleaning device (reference number 400) is shown in FIGS. 8*a* through 8*c*. FIG. 8*a* shows an oval rubber-type membrane element 59 that is arranged on the upper part of the handgrip 1, in which a matching oval opening has been cut.

FIG. 8*b* shows a different embodiment example of a membrane element that is connected with the hollow body 11 of the handgrip 1 via a bellows element 58. The membrane element 59 extends a little above the mantle surface of the hollow body 11 so that a correspondingly greater volume may be swept.

FIG. 8*c* shows another embodiment example of a membrane element that extends almost the entire length of the hollow body 11, namely along its side facing the cleaning surface 4. The membrane element is manufactured from plastic as one piece with the hollow body 11, so that a part of the handgrip is elastically deformable while the remaining hollow body is rigid.

Figure 9:
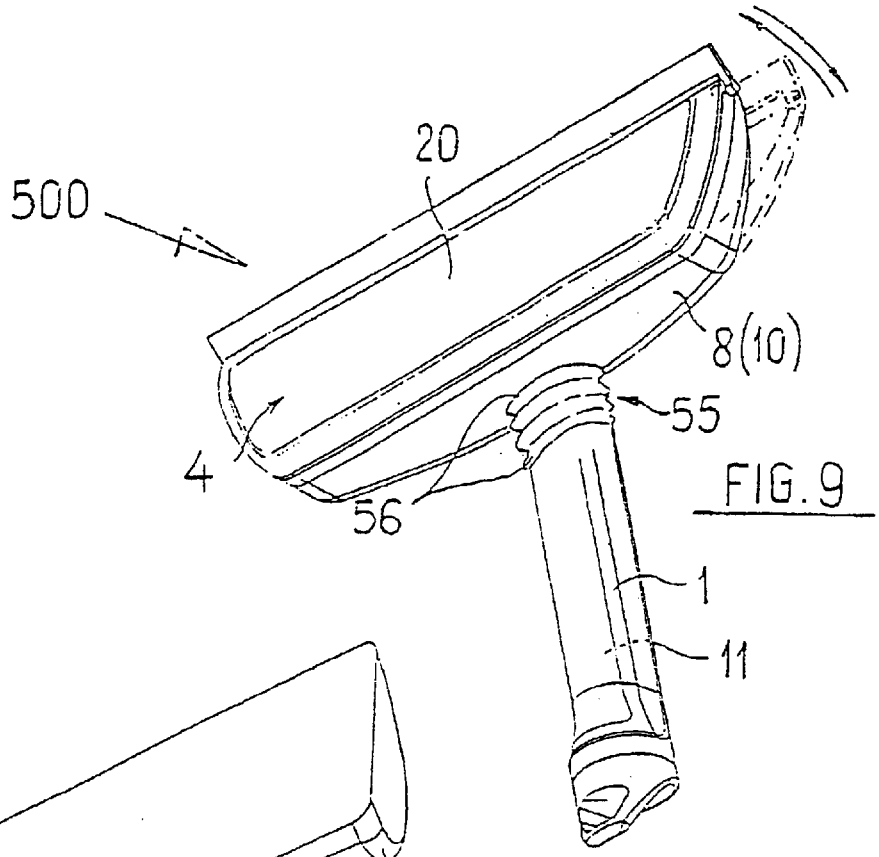
FIG. 9 is a further preferred embodiment of the cleaning device with a swivel.

FIG. 9 shows another embodiment example of the cleaning device (reference number 500) in which the handgrip 1 is connected with the crosspiece 8 via a swivel element 55.

The swivel element 55 in this case consists of several plastic blades 56 that allow swiveling of the crosspiece 8 in practically all directions, as with a ball swivel. In such a cleaning device, both a piston pump 9 and a membrane element 59 may be used (not shown).

Figure 10:
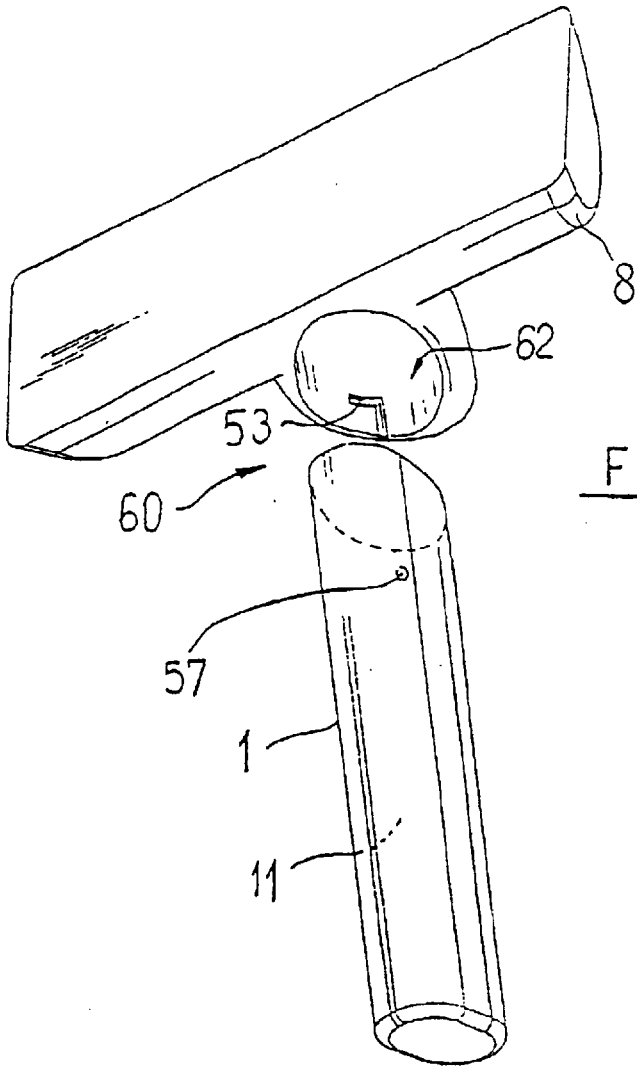
FIG. 10 is a schematic view of a bayonet mount for a cleaning device.

FIG. 10 shows schematically a special connection of the handgrip 1 with the crosspiece 8. An outward projection 57 is mounted on the hollow body 11 that is compatible with an L-shaped slot 53 running into an opening 62 (in the thickening 24 of the crosspiece), forming a bayonet connection 60. For this, a corresponding seal ring is of course provided (not shown).

Figure 11:
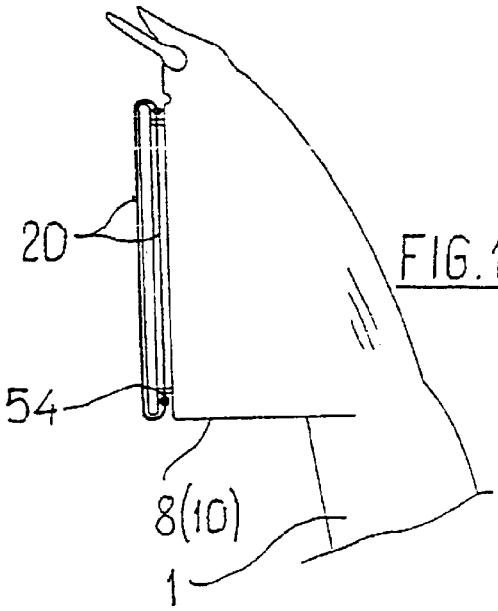
FIG. 11 shows how a cloth may be mounted as a hood on a cleaning device.

FIG. 11 shows a fleece cloth 20 that is mounted as a hood on the dirt-removing element 7 by means of a surrounding rubber band 54 so that it may be removed.

Figure 12:
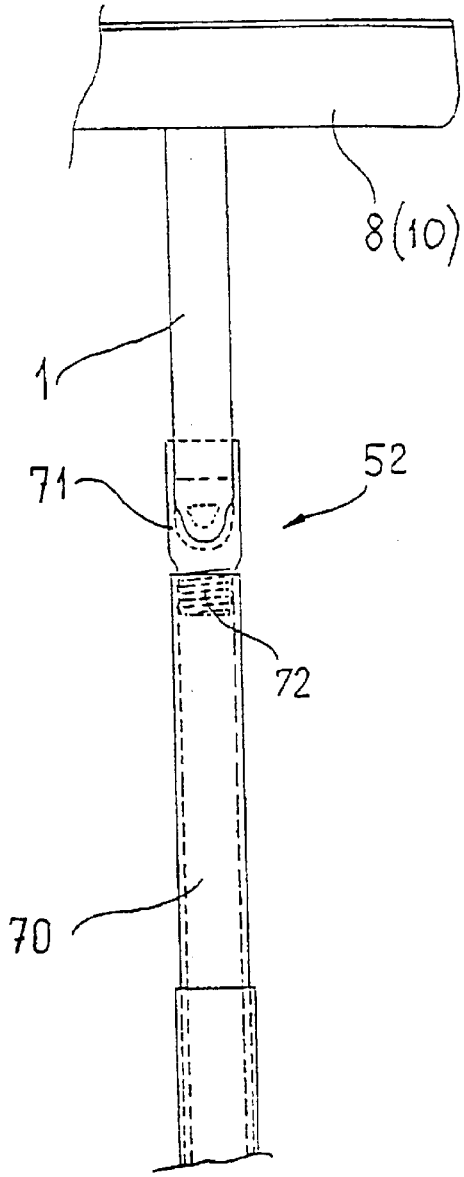
FIG. 12 shows a handle extension for a cleaning device.

In order to simplify operation of the cleaning device based on the invention, for example during cleaning of a glass roof of a greenhouse, the handgrip 1 is connected via an adapter 71 with a telescoping variable-length handle extension 70 (see FIG. 12). The adapter 71 fits over the lower end 52 of the handgrip, and is clamped there. The handle extension 70 including a flexible joint is screwed into the adapter 71 (thread 72). The handle extension 70 may also be screwed into an internal thread 64 (see FIG. 5) on the lower end 52 (end piece) of the handgrip, or within the handgrip.

There has thus been shown and described a novel cleaning device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a cleaning device for smooth surfaces, particularly for cleaning windows, comprising the following components:

(a) an elongate handgrip;

(b) a contact element mounted on one end of the handgrip, and extending substantially perpendicular to the handgrip, said contact element having a front side and having an area behind the front side for the temporary storage and distribution of the cleaning fluid; and (c) a surface cleaning element, capable of being moistened with cleaning fluid, disposed on the front side of the contact element for making contact with the surface to be cleaned, (d) the handgrip being formed as a substantially cylindrical hollow body serving as a reservoir for at least a part of the cleaning fluid;

the improvement wherein the area for the temporary storage and distribution of the cleaning fluid includes an at least partially-hollow, flat dirt-removing element with at least one capillary matrix distributing the cleaning fluid, wherein the surface cleaning element is attached to the dirt-removing element so that it may be removed, and wherein the contact element is provided with a pump, which is operative to transfer the cleaning fluid to the dirt-removing element, and a recess in the area where it connects with the handgrip, said recess at least partially accommodating an actuation lever for a the pump.

2. Cleaning device recited in claim 1, wherein the pump is a piston pump.

3. Cleaning device recited in claim 1, wherein the area for the temporary storage and distribution of the cleaning fluid of the dirt-removing element is connected with a tube through which the cleaning fluid may be pumped.

4. Cleaning device recited in claim 1, wherein the dirt-removing element includes a slot on its front side parallel to its upper edge that feeds into a second slot, extending toward the center of the dirt-removing element, that in turn ends at an opening through the dirt-removing element, by means of which the cleaning fluid may be pumped into the first and second slots and into the capillary matrix.

5. Cleaning device recited in claim 4, wherein the capillary matrix is congruent with the first slot of the dirt-removing element.

6. Cleaning device recited in claim 1, wherein a front side of the surface cleaning element, for making contact with the surface to be cleaned, is formed by a section of moisture-permeable textile or sponge-like material.

7. Cleaning device recited in claim 6, wherein the section is made of a cloth selected from the group consisting of woven fabric, knitted fabric, and micro-fiber fleece.

8. Cleaning device recited in claim 7, wherein the cloth is removably attached to at least one of the surface cleaning element, the dirt-removing element and the front side of the contact element and surrounds it as a hood.

9. Cleaning device recited in claim 6, wherein the surface cleaning element is removably attached to the dirt-removing element.

10. Cleaning device recited in claim 9, wherein the surface cleaning element is removably attached with at least one hook and loop fastener to the dirt-removing element.

11. Cleaning device recited in claim 6, wherein the section is dirt-absorbing on both sides.

12. Cleaning device recited in claim 1, wherein the dirt-removing element is provided with a squeegee strip made of synthetic rubber material and mounted on its upper edge.

13. Cleaning device recited in claim 12, wherein the output plate is provided with a strip extending above a flat side that engages in a slot on the dirt-removing element that serves as a securing element for the squeegee strip.

14. Cleaning device recited in claim 13, wherein the dirt-removing element includes an inclined reinforced strip and wherein the squeegee strip is secured in the slot by the reinforced strip and the strip of the output plate.

15. Cleaning device recited in claim 13, wherein the squeegee strip is secured in the slot so that it may swivel.

16. Cleaning device recited in claim 1, wherein the contact element is formed as one piece with the handgrip.

17. Cleaning device recited in claim 1, wherein the dirt-removing element is removably connected with the contact element.

18. Cleaning device recited in claim 1, wherein the dirt-removing element includes an output plate provided with the capillary matrix positioned adjacent the surface cleaning element.

19. Cleaning device recited in claim 18, wherein the handgrip is attached to the handle extension by means of an adapter.

20. Cleaning device recited in claim 1, wherein the handgrip is connected with the contact element so that it may swivel.

21. Cleaning device recited in claim 1, wherein the handgrip is attached to the contact element by a bayonet connection.

22. Cleaning device recited in claim 1, wherein the handgrip is attached to a handle extension by a connection selected from the group consisting of a threaded, clamping, and ratcheting connector.

23. Cleaning device recited in claim 22, wherein the handle extension is a telescoping variable-length handle extension.

* * * * *